US011452947B2

(12) United States Patent
Xue

(10) Patent No.: US 11,452,947 B2
(45) Date of Patent: Sep. 27, 2022

(54) PULL BACK VEHICLE CAPABLE OF SWITCHING TRAVELLING LINES

(71) Applicant: Hua Xue, Shenzhen (CN)

(72) Inventor: Hua Xue, Shenzhen (CN)

( * ) Notice: Subject to any disclaimer, the term of this patent is extended or adjusted under 35 U.S.C. 154(b) by 41 days.

(21) Appl. No.: 17/060,151

(22) Filed: Oct. 1, 2020

(65) Prior Publication Data

US 2022/0105438 A1 Apr. 7, 2022

(51) Int. Cl.
*A63H 17/26* (2006.01)
*A63H 17/40* (2006.01)

(52) U.S. Cl.
CPC ..... *A63H 17/262* (2013.01); *A63H 17/40* (2013.01)

(58) Field of Classification Search
CPC ..... A63H 17/262; A63H 17/40; A63H 29/24; A63H 29/02; A63H 29/04
See application file for complete search history.

(56) References Cited

U.S. PATENT DOCUMENTS 1,643,903 A * 9/1927 Prosser ..... A63H 29/04 446/442
1,756,539 A * 4/1930 De Filippis ..... A63H 17/395 446/436
2,172,416 A * 9/1939 Swenson ..... A63H 17/06 74/440
4,077,156 A * 3/1978 Asano ..... A63H 29/02 446/464
4,232,479 A * 11/1980 von Winckelmann ..... A63H 17/36 446/457
4,241,534 A * 12/1980 Larsson ..... A63H 31/00 192/48.92
4,422,261 A * 12/1983 Kozuka ..... A63H 13/00 446/290
4,488,375 A * 12/1984 Cheng ..... A63H 17/262 446/470
4,786,269 A * 11/1988 Nagel ..... A63H 31/00 446/464
4,836,819 A * 6/1989 Oishi ..... A63H 11/10 446/353
4,846,756 A * 7/1989 Hesse ..... A63H 18/12 446/469
6,231,422 B1 * 5/2001 Choi ..... A63H 17/40 446/444
9,387,411 B1 * 7/2016 Thompson ..... A63H 17/262
(Continued)

FOREIGN PATENT DOCUMENTS

CN 203989854 U 12/2014
CN 110152317 U 8/2019

*Primary Examiner* — Eugene L Kim
*Assistant Examiner* — Alyssa M Hylinski
(74) *Attorney, Agent, or Firm* — Ware, Fressola, Maguire & Barber LLP

(57) ABSTRACT

The disclosure relates to the technical field of toy vehicles, in particular to a pull back vehicle capable of switching travelling lines including a pull back vehicle chassis. The pull back vehicle chassis includes a driving gear box, driving wheel, a driving gear, a steering wheel shaft, steering wheels and a centering spring. The pull back vehicle chassis is fixedly installed with the driving gear box, the driving gear box is fixedly connected with a driving axle, the driving axle is fixedly connected with the driving gear, and the driving axle is fixedly connected with the driving wheel, and the pull back vehicle chassis is fixedly connected with the steering wheel shaft.

6 Claims, 8 Drawing Sheets

(56) References Cited

U.S. PATENT DOCUMENTS

| | | | |
|---|---|---|---|
| 9,579,585 | B2 | 2/2017 | Silverglate et al. |
| 2011/0104982 | A1 | 5/2011 | Koehl |
| 2019/0336873 | A1 | 11/2019 | Kwan |

* cited by examiner

PULL BACK VEHICLE CAPABLE OF SWITCHING TRAVELLING LINES

TECHNICAL FIELD

The disclosure relates to the technical field of pull back vehicle devices, in particular to a pull back ea vehicle capable of switching travelling lines.

BACKGROUND OF THE PRESENT INVENTION

The pull back vehicle generally drives wheels to rotate through a pull back driving device, so that a toy vehicle has the same effect as a real vehicle. Existing pull back vehicles simply travel in a straight line or in an S-line, and a number of sets of transmission equipment are required to be matched so as to be able to switch in a straight line or in an S-line at will, which is relatively expensive and cannot be widely used in common family.

Currently, most of the pull back vehicles on the market travel in a straight-line or an S-line travel only, and cannot switch the travelling lines at will, resulting that the playing method is single, and the interest is insufficient. Therefore, there is an urgent need for a toy vehicle that can switch travelling lines to solve the above problems.

SUMMARY OF PRESENT INVENTION

The object of the disclosure is to provide a pull back ese vehicle capable of switching travelling lines to solve the problem that the pull back vehicle cannot switch travel paths proposed in the background.

In order to achieve the above object, the disclosure provides the following technical solution: a pull back ee vehicle capable of switching travelling lines, including a pull back em vehicle chassis, wherein the pull back vehicle chassis includes a driving gear box, driving wheel, a driving gear, a steering wheel shaft, steering wheels and a centering spring; the pull back vehicle chassis is fixedly installed with the driving gear box, the driving gear box is fixedly connected with a driving axle, the driving axle is fixedly connected with the driving gear, and the driving axle is fixedly connected with the driving wheel; and the pull back vehicle chassis is fixedly connected with the steering wheel shaft, the pull back vehicle chassis is fixedly connected with the steering wheels, the pull back vehicle chassis is fixedly installed with the centering spring, the driving gear box is fixedly connected with an S-typed steering assembly, and the pull back vehicle chassis is fixedly connected with a clutch assembly.

Preferably, the S-typed steering assembly includes a clutch gear and a driven gear, the driving gear is meshed and connected with the clutch gear, and the clutch gear is fixedly connected with the driven gear.

Preferably, the S-typed steering assembly includes a first connecting gear, a transmission gear, a second connecting gear, a speed changing gear A, a third connecting gear, and a speed changing gear B; the driven gear is meshed and connected with the first connecting gear, and the first connecting gear is meshed and connected with the transmission gear, the transmission gear is meshed and connected with the second connecting gear, and the second connecting gear is fixedly connected with the speed changing gear A, and the speed changing gear A is meshed and connected with the third connecting gear, and the third connecting gear is fixedly connected with the speed changing gear B.

Preferably, the S-typed steering assembly includes a steering gear, a crown gear, a steering assembly, a first push rod and a second push rod; the speed changing gear B is meshed and connected with the steering gear, and the steering gear is fixedly connected with the crown gear, the steering wheel shaft is fixedly connected with the steering assembly, and the steering assembly is fixedly connected with the first push rod, and the steering assembly is fixedly connected with the second push rod.

Preferably, the clutch assembly includes a connecting rod, a rotating rod and a toggle rod; the clutch gear is fixedly connected with the connecting rod, and the connecting rod fits against the rotating rod, and the rotating rod abuts against the toggle rod.

Compared with the prior art, the beneficial effect of the disclosure is that the pull back vehicle capable of travelling in a straight line and an S-line transmits a part of the driving force of the driving gear box to the steering gear and the steering assembly through the gear set, so that the steering assembly will turn in order of leftward-centering-rightward-centering, and the pull back vehicle travels in an S-shaped path. By clutching any part of the above structure, the power transmission between the driving gear box and the steering assembly is disconnected, thereby realizing switching the pull back vehicle from travelling in an S-shaped path to travelling in a straight line path.

(1) The device is provided with a steering gear and a steering assembly, the rotation of the steering gear drives the crown gear to rotate, and then the crown gear pushes the abutted push rod to move. As an elongated hole of the steering assembly is restricted by the circular post in the middle of the crown gear, the steering assembly will turn in order of leftward-centering-rightward-centering, and the pull back vehicle travels in an S-shaped path.

(2) In the device, the toggle rod is toggled to push the rotating rod so as to move the connecting rod, thereby allowing the clutch gear to engage with or disengage from the driving gear, thereby realizing switching the pull back ea vehicle from travelling in an S-shaped path to travelling in a straight line path.

DESCRIPTION OF THE DRAWINGS

FIGS. 4A-4C are schematic diagrams of a crown gear and push rods of the structure of the disclosure; wherein FIG. 4A shows the steering gear starts to rotate; FIG. 4B shows the crown gear rotates to a certain angle; FIG. 4C shows the steering assembly rotate in the opposite direction under the action of the crown gear;

Figure 1:
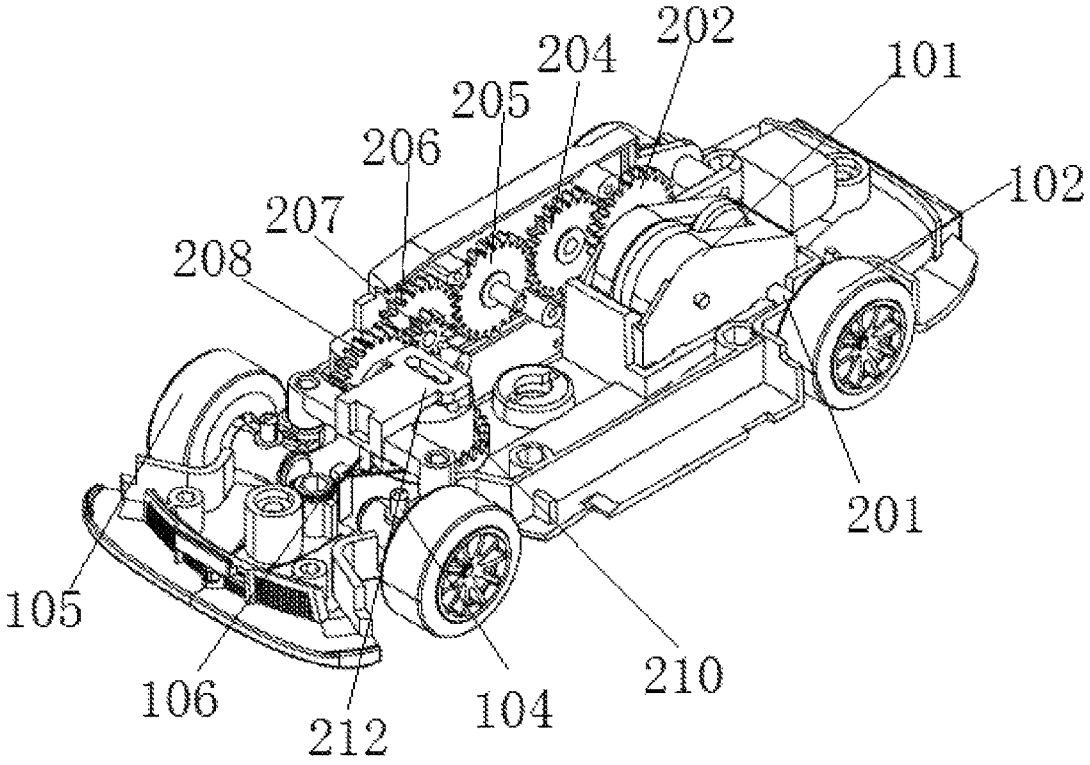
FIG. 1 is an overall schematic diagram of the structure of the disclosure.

In the figures: 1, pull back vehicle chassis; 101, driving gear box; 102, driving wheel; 103, driving gear; 104, steering wheel shaft; 105, steering wheels; 106, centering spring; 2, S-typed steering assembly; 201, driving axle; 202, clutch gear; 203, driven gear; 204, first connecting gear; 205, transmission gear; 206, second connecting gear; 207, speed changing gear A; 208, third connecting gear; 209, speed changing gear B; 210, steering gear; 211, crown gear; 212, steering assembly; 213, first push rod; 214, second push rod; 3, clutch assembly; 301, connecting rod; 302, rotating rod; 303, toggle rod.

DETAILED DESCRIPTION OF PREFERRED EMBODIMENTS

The technical solution in the embodiments of the disclosure will be clearly and completely described in conjunction with the accompanying drawings in the embodiments of the disclosure below, and obviously, the described embodiments are only a part of the embodiments of the disclosure, not all embodiments. Based on the embodiments of the disclosure, all other embodiments obtained by those of ordinary skilled in the art without creative efforts hall fall within the protection scope of the disclosure.

Please referring to FIGS. 1-7, an embodiment is provided by the disclosure: a pull back vehicle capable of switching travelling lines, which includes a pull back vehicle chassis 1, the pull back vehicle chassis 1 includes a driving gear box 101, driving wheel 102, a driving gear 103, a steering wheel shaft 104, steering wheels 105 and a centering spring 106, the pull back vehicle chassis 1 is fixedly installed with the driving gear box 101, the driving gear box 101 is fixedly connected with a driving axle 201, the driving axle 201 is fixedly connected with the driving gear 103, the driving axle 201 is fixedly connected with the driving wheel 102, the pull back vehicle chassis 1 is fixedly connected with the steering wheel shaft 104, the pull back vehicle chassis 1 is fixedly connected with the steering wheels 105, the pull back vehicle chassis 1 is fixedly installed with the centering spring 106, the driving gear box 101 is fixedly connected with an S-typed steering assembly 2, and the pull back vehicle chassis 1 is fixedly connected with a clutch assembly 3.

Further, the S-typed steering assembly 2 includes a clutch gear 202 and a driven gear 203, the driving gear 103 is meshed and connected with the clutch gear 202, and the clutch gear 202 is fixedly connected with the driven gear 203, which facilitates to change the travel path of the vehicle by adjusting the clutch gear 202.

Further, the S-typed steering assembly 2 includes a first connecting gear 204, a transmission gear 205, a second connecting gear 206, a speed changing gear A 207, a third connecting gear 208, and a speed changing gear B 209, the driven gear 203 is meshed and connected with the first connecting gear 204, and the first connecting gear 204 is meshed and connected with the transmission gear 205, the transmission gear 205 is meshed and connected with the second connecting gear 206, and the second connecting gear 206 is fixedly connected with the speed changing gear A 207, and the speed changing gear A 207 is meshed and connected with the third connecting gear 208, and the third connecting gear 208 is fixedly connected with the speed changing gear B 209, which facilitates rotation of multiple sets of gears through rotation of the driven gear 203, while gears with smaller size such as the speed changing gear A 207 and the speed changing gear B 209 are used to reduce the speed when in rotation to avoid turning over due to too fast steering.

Further, the S-typed steering assembly 2 includes a steering gear 210, a crown gear 211, a steering assembly 212, a first push rod (213) and a second push rod (214), the speed changing gear B 209 is meshed and connected with the steering gear 210, and the steering gear 210 is fixedly connected with the crown gear 211, the steering wheel shaft 104 is fixedly connected with the steering assembly 212, and the steering assembly 212 is fixedly connected with the first push rod 213, and the steering assembly is fixedly connected with the second push rod (214).

Further, the clutch assembly 3 includes a connecting rod 301, a rotating rod 302 and a toggle rod 303, the clutch gear 202 is fixedly connected with the connecting rod 301, and the connecting rod 301 fits against the rotating rod 302, and the rotating rod 302 abuts against the toggle rod 303.

Further, the arrangement of the steering wheel and the driving wheel is generally the steering wheel in the front and the driving wheel in the rear, and the first arrangement of the wheels of the toy vehicle in this embodiment is that the front wheel is the steering wheel and the rear wheel is the driving wheels. While in the other arrangement, the front wheel is the driving wheel and the rear wheel is the steering wheel. Both the front drive and the rear drive can realize the purpose of switching the travelling lines of the toy vehicle.

Figure 2:
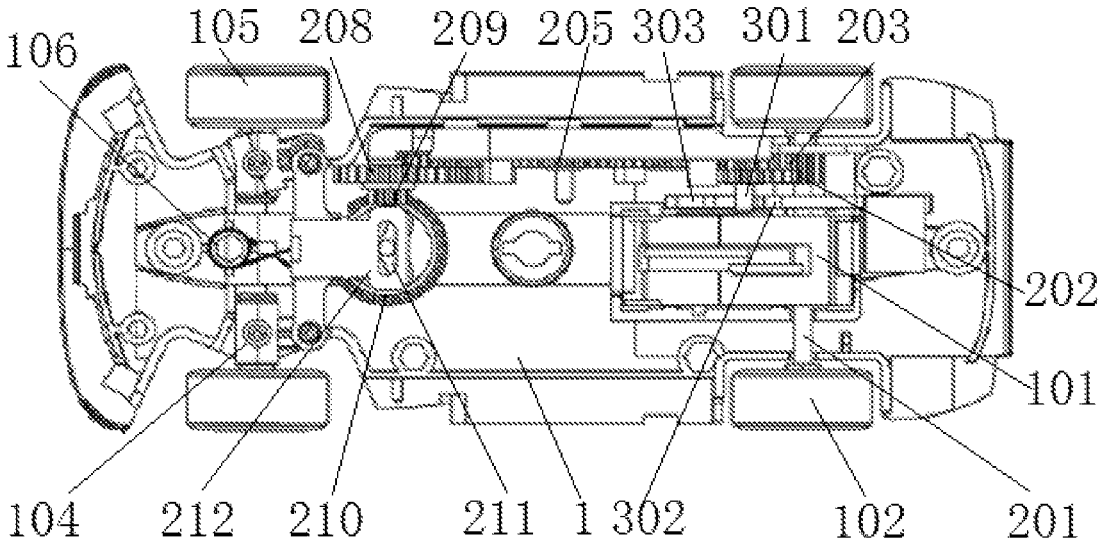
FIG. 2 is schematic top sectional view of the structure of the disclosure.
Figure 3:
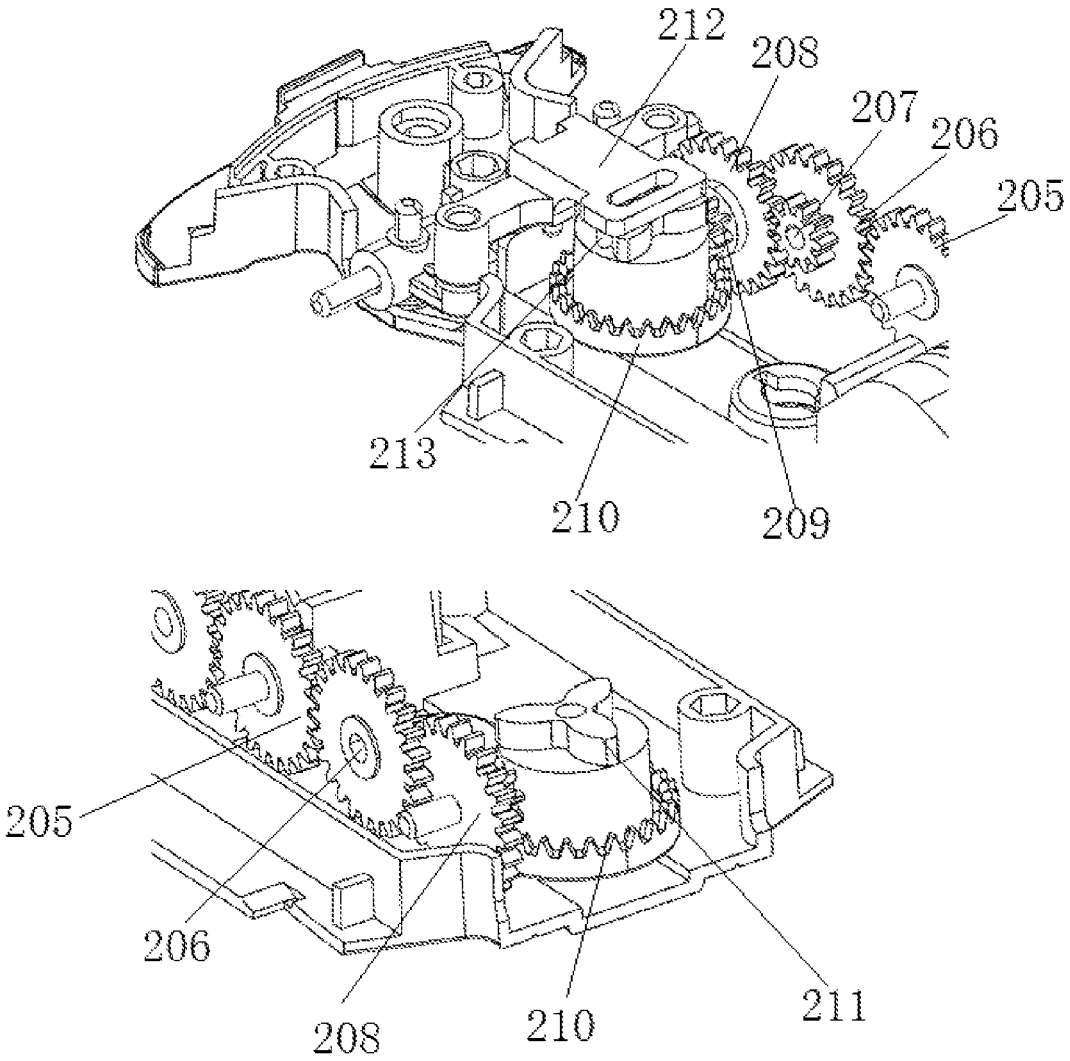
FIG. 3 is a schematic diagram of the structure of a steering gear of the disclosure.
Figure 4A:
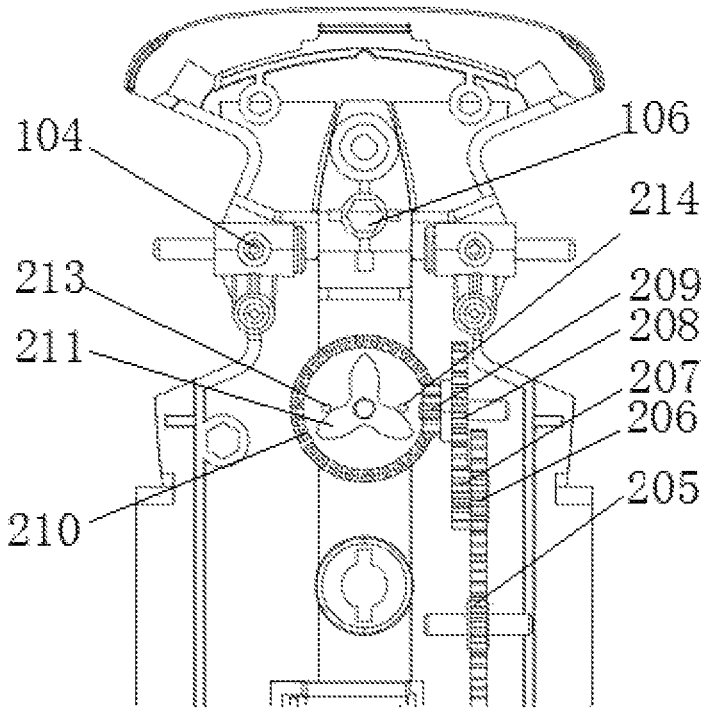
Figure 4B:
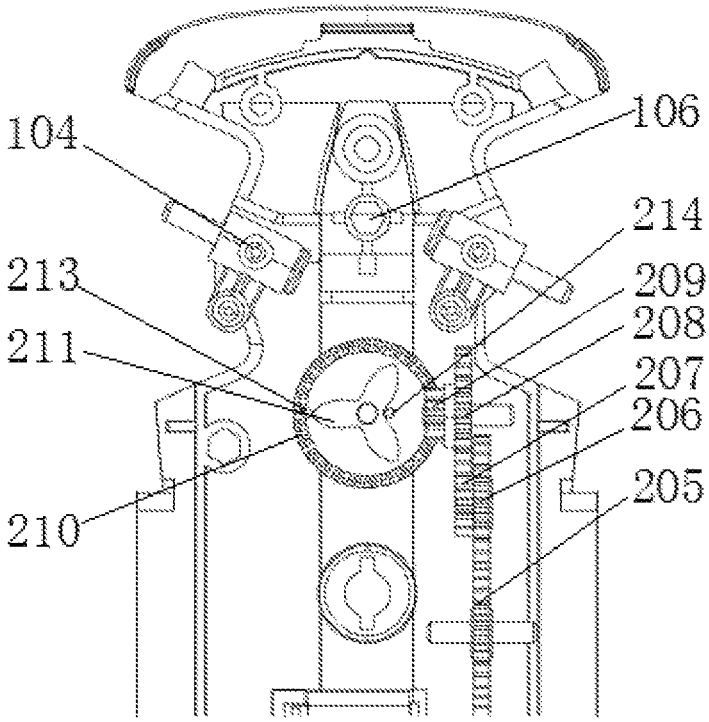
Figure 4C:
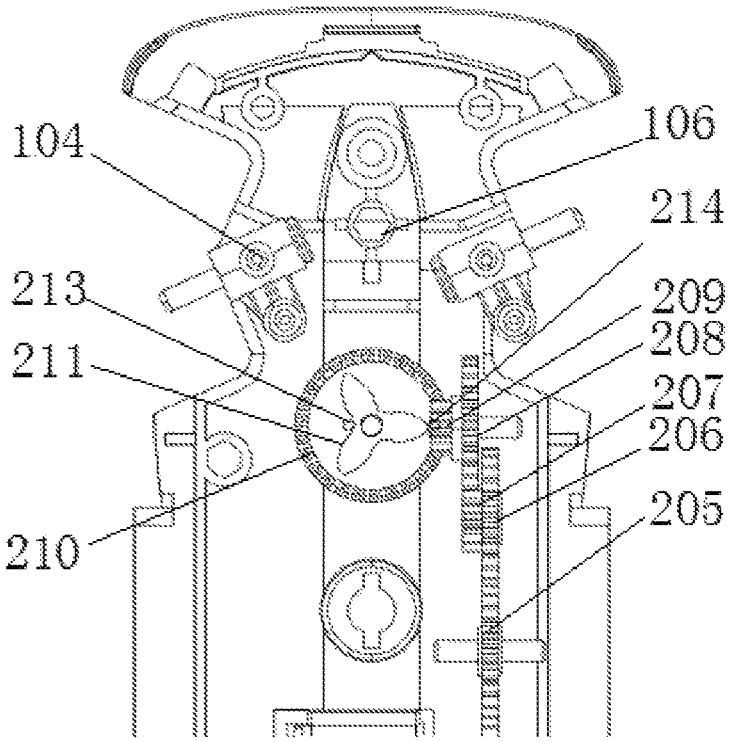
Figure 5:
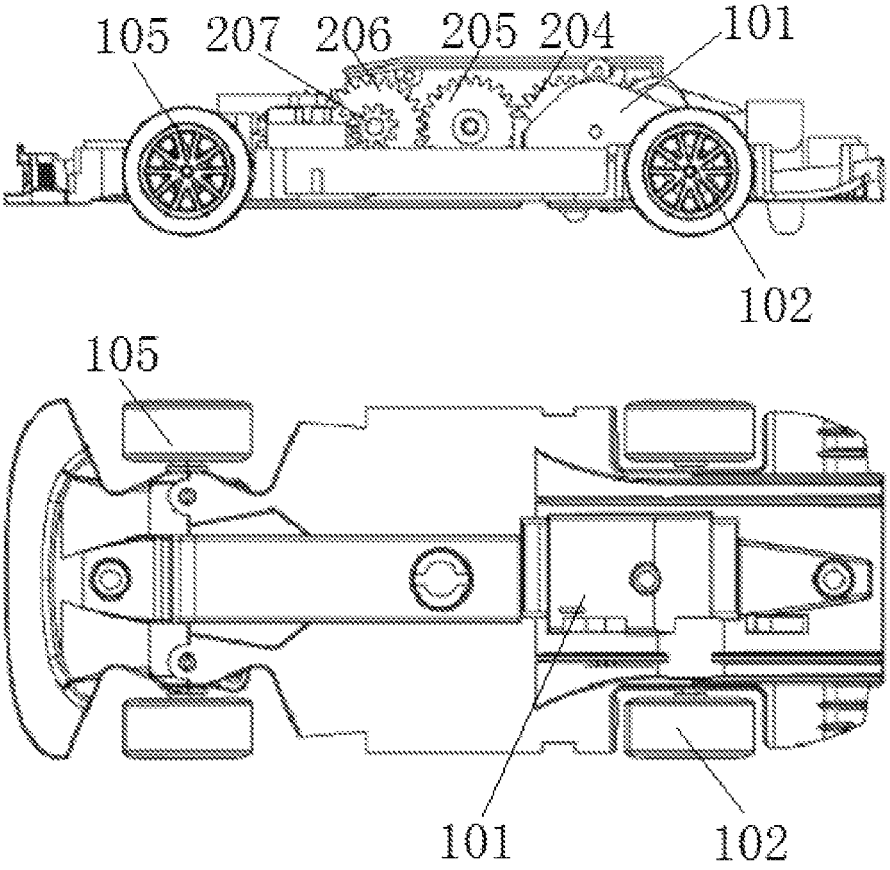
FIG. 5 is a schematic side view and bottom view of the structure of the disclosure.
Figure 6:
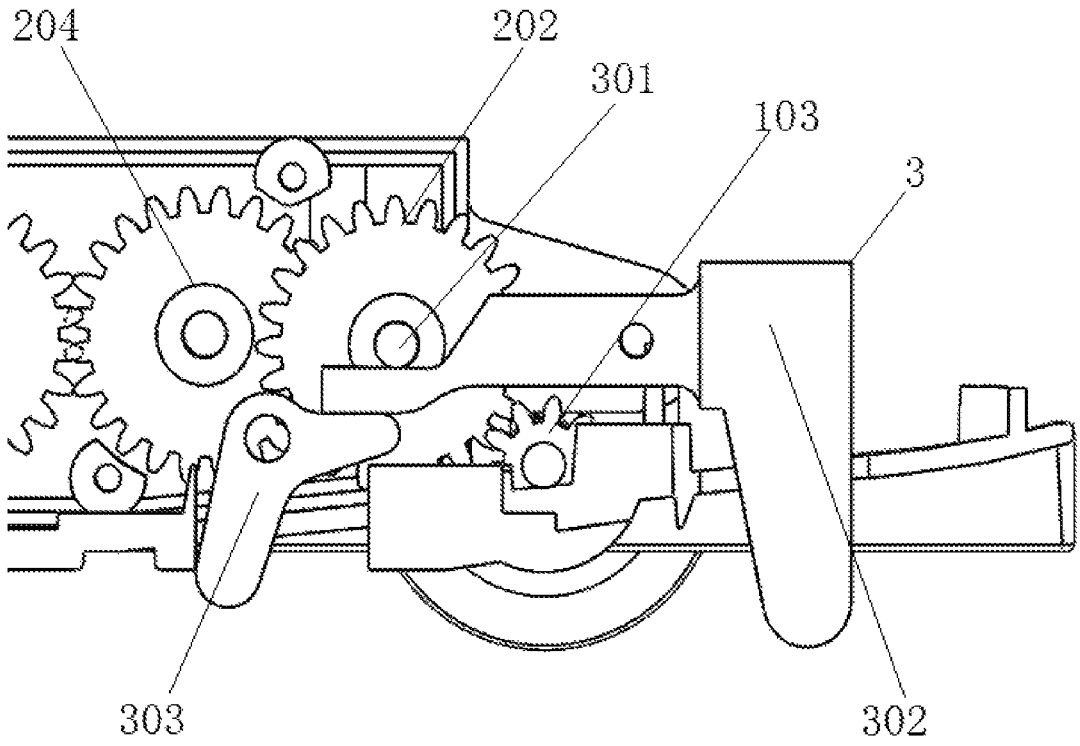
FIG. 6 is a schematic diagram of the structure of a connecting rod and a rotating rod of the disclosure.

Working principle thereof is as follows: as shown in FIG. 6, when the vehicle is desired to be moved along the S-shaped path, the driving wheel 102 are rotated in a reverse direction, so that a certain driving force is generated by rotation of the pull back gear in the driving gear box 101 of the pull back driving assembly. When the device is released, under the operation of the driving gear box 101, the driving gear 103 starts to rotate, since the clutch gear 202 and the driving gear 103 mesh with each other, as the driving gear 103 rotates, the clutch gear 202 starts to rotate. As shown in FIGS. 1 and 2, when the driven gear 203 starts to rotate, since the driven gear 203 and the first connecting gear 204 mesh with each other, the first connecting gear 204 and the transmission gear 205 mesh with each other, the transmission gear 205 and the second connecting gear 206 mesh with each other, and the speed changing gear A 207 and the third connecting gear 208 mesh with each other, and the speed changing gear B 209 and the steering gear 210 mesh with each other, as the speed changing gear B 209 rotates, the steering gear 210 starts to rotate. While since the driven gear 203, the speed changing gear A 207, and the speed changing gear B 209 are smaller in size than several sets of connecting gears, the rotation range of the gears and the speed when steering may both be reduced without affecting the movement of the device, thus avoiding excessive steering speed which causes the device to turn over. When the steering gear 210 starts to rotate, as shown in FIG. 4A, the crown gear 211 starts to rotate, and when the crown gear 211 abuts against the first push rod 213, it will drive the first push rod 213 to rotate by a certain angle, thereby driving the steering assembly 212 to rotate by a certain angle. As an elongated hole at the top of the steering assembly 212 is restricted by the circular post in the middle of the crown gear 211, the steering assembly will deviate to the left and drive the steering wheel shaft 104 to steer. When the crown gear 211 rotates to FIG. 4B, the second push rod 214 will slide by a certain angle along the concave surface of the crown gear 211, so that the steering assembly 212 will rotate in the opposite direction under the action of the crown gear 211, as shown in FIG. 4C, the vehicle will turn to the other side, so that the steering assembly will turn in order of leftward-centering-rightward-centering, and then the vehicle travels in an S-shaped path. When the vehicle is stationary, if the steering wheels 105 is in an offset state, and the centering spring 106 is on the side of the steering assembly 212 to generate a certain torsion force to return the steering assembly 212, so that the steering wheels 105 are centered.

Figure 7:
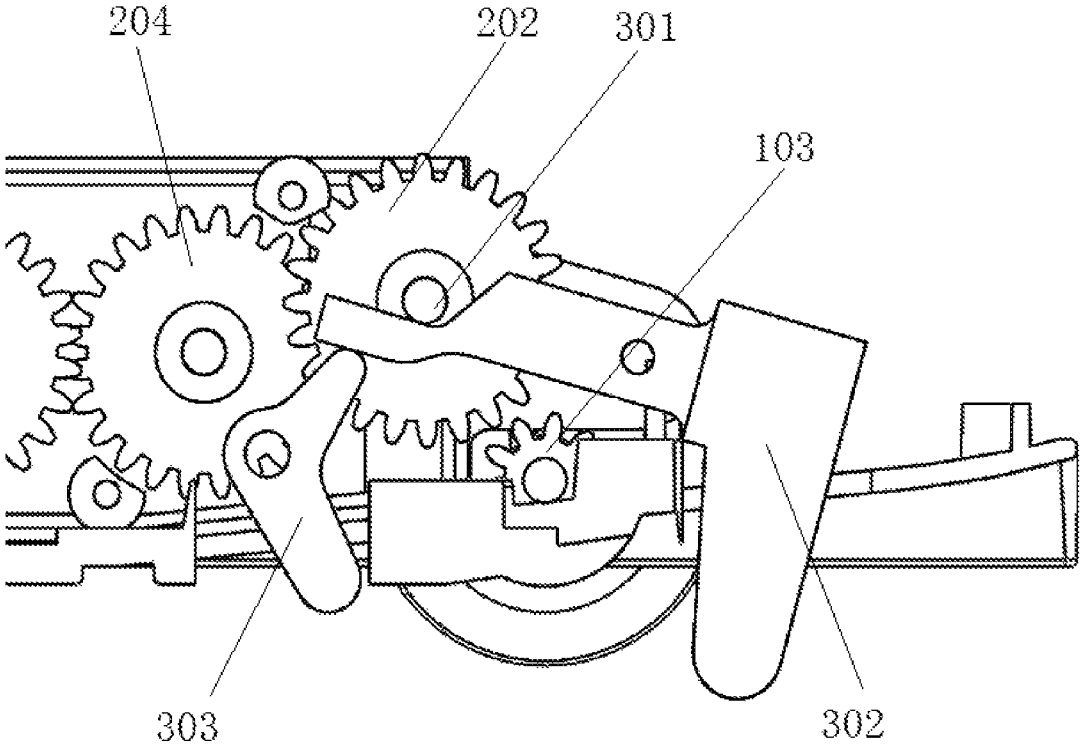
FIG. 7 is a schematic diagram of the structure of a toggle rod of the disclosure.

When the pull back vehicle chassis 1 is desired to only travel in a straight line, as shown in FIGS. 6 and 7, when the toggle rod 303 is toggled on the outer side of the pull back vehicle chassis 1, the toggle rod 303 will rotate while pushing the rotating rod 302, thus the rotating rod 302 will push the connecting rod 301 to move toward the side away from the driving gear 103 until the clutch gear 202 and the driving gear 103 no longer mesh with each other, so that the entire device only provides driving force to the driving wheel 102 through the driving gear box 101, thereby the driving wheel 102 allow the pull back vehicle chassis 1 to travel in a straight line.

To those skilled in the art, it is obvious that the disclosure is not limited to the details of the above exemplary embodiments. The technology of the toy vehicle mainly lies in the chassis, and the shape of the vehicle body is not restricted. The disclosure can be implemented in other specific forms without departing from the spirit or basic characteristics of the disclosure. Therefore, no matter from which perspective, the embodiments should be regarded as exemplary and non-limiting, and the scope of the disclosure is defined by the appended claims rather than the above description, and therefore all the changes falling in the meaning and scope of the equivalent elements of the claims are included in the disclosure. Any reference signs in the claims should not be regarded as limiting the claims involved.

I claim:

1. A pull back vehicle travelling in both straight line and an S-line, comprising a pull back vehicle chassis;

the pull back vehicle chassis comprising a driving gear box, driving wheel, a driving gear, a steering wheel shaft, steering wheels and a centering spring;

the pull back vehicle chassis being installed with the driving gear box, the driving gear box being connected with a driving axle, the driving axle being connected with the driving gear, and the driving axle being connected with the driving wheel;

the pull back vehicle chassis being connected with the steering wheel shaft, the pull back vehicle chassis being connected with the steering wheels, the pull back vehicle chassis being installed with the centering spring, the driving gear box being connected with an S-typed steering assembly for realizing an S-type steering functionality and making the pull back vehicle travel on an S-shaped path, and the pull back vehicle chassis being connected with a clutch assembly;

the S-typed steering assembly comprising the driving axle, a clutch gear and a driven gear, the driving gear box being connected with the driving axle, the driving axle being connected with the driving gear, the driving gear being meshed and connected with the clutch gear in order to make the pull back vehicle travel on the S-shaped path, and the clutch gear being connected with the driven gear; and upon actuation of the clutch assembly, the clutch gear disengaging the driving gear, in order to deactivate the S-type steering functionality and make the pull back vehicle travel on a straight path.

2. The pull back vehicle of claim 1, wherein the S-typed steering assembly further comprises a first connecting gear, a transmission gear, a second connecting gear, a speed changing gear A, a third connecting gear, and a speed changing gear B;

the driven gear is meshed and connected with the first connecting gear;

the first connecting gear is meshed and connected with the transmission gear;

the transmission gear is meshed and connected with the second connecting gear;

the second connecting gear is connected with the speed changing gear A;

the speed changing gear A is meshed and connected with the third connecting gear; and the third connecting gear is connected with the speed changing gear B.

3. The pull back vehicle of claim 2, wherein the S-typed steering assembly further comprises a steering gear, a crown gear, a steering link, a first push rod and a second push rod;

the speed changing gear B is meshed and connected with the steering gear, and the steering gear is connected with the crown gear;

the steering wheel shaft is connected with the steering link;

the steering link is connected with the first push rod; and the steering link is connected with the second push rod.

4. The pull back vehicle of claim 1, wherein the clutch assembly comprises a connecting rod, a rotating rod and a toggle rod;

the clutch gear is connected with the connecting rod; and the connecting rod fits against the rotating rod; and the rotating rod abuts against the toggle rod.

5. A pull back car travelling in both straight line and an S-line, comprising a pull back car chassis;

the pull back car chassis comprising a driving gear box, driving wheel, a driving gear, a steering wheel shaft, steering wheels and a centering spring;

the pull back car chassis being installed with the driving gear box, the driving gear box being connected with a rear axle, the driving axle being connected with the driving gear, and the driving axle being connected with the driving wheel; and the pull back car chassis being connected with the steering wheel shaft, the pull back car chassis being is connected with the steering wheels, the pull back car chassis being installed with the centering spring, the driving gear box being connected with an S-typed steering assembly, and the pull back car chassis being connected with a clutch assembly, the S-typed steering assembly comprising the driving axle, a clutch gear and a driven gear, the driving gear box being connected with the driving axle, the driving axle being connected with the driving gear, the driving gear being meshed and connected with the clutch gear, and the clutch gear being connected with the driven gear;

the S-typed steering assembly further comprising a first connecting gear, a transmission gear, a second connecting gear, a speed changing gear A, a third connecting gear, and a speed changing gear B; and the driven gear being meshed and connected with the first connecting gear, the first connecting gear being meshed and connected with the transmission gear, the transmission gear being meshed and connected with the second connecting gear, the second connecting gear being connected with the speed changing gear A, the speed changing gear A being meshed and connected with the third connecting gear, and the third connecting gear being connected with the speed changing gear B.

6. A pull back vehicle travelling in both straight line and an S-line, comprising a pull back vehicle chassis;

the pull back vehicle chassis comprising a driving gear box, driving wheel, a driving gear, a steering wheel shaft, steering wheels and a centering spring;

the pull back vehicle chassis being installed with the driving gear box, the driving gear box being connected with a driving axle, the driving axle being connected with the driving gear, and the driving axle being connected with the driving wheel; and the pull back vehicle chassis being connected with the steering wheel shaft, the pull back vehicle chassis being connected with the steering wheels, the pull back vehicle chassis being installed with the centering spring, the driving gear box being connected with an S-typed steering assembly, and the pull back vehicle chassis being connected with a clutch assembly;

the S-typed steering assembly comprising the driving axle, a clutch gear and a driven gear, the driving gear box being connected with the driving axle, the driving axle being connected with the driving gear, the driving gear being meshed and connected with the clutch gear, and the clutch gear being connected with the driven gear;

the clutch assembly comprising a connecting rod, a rotating rod and a toggle rod;

the clutch gear being connected with the connecting rod, the connecting rod fitting against the rotating rod, and the rotating rod abutting against the toggle rod.

* * * * *